US007104766B2

(12) United States Patent
Mascola

(10) Patent No.: US 7,104,766 B2
(45) Date of Patent: Sep. 12, 2006

(54) HORIZONTAL CENTRIFUGAL PUMPING SYSTEM

(75) Inventor: James V. Mascola, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 355 days.

(21) Appl. No.: 10/444,223

(22) Filed: May 23, 2003

(65) Prior Publication Data

US 2003/0219347 A1 Nov. 27, 2003

Related U.S. Application Data

(60) Provisional application No. 60/382,891, filed on May 23, 2002.

(51) Int. Cl.
*F04B 17/00* (2006.01)
*F16C 19/10* (2006.01)

(52) U.S. Cl. ..... 417/365; 384/606

(58) Field of Classification Search ..... 417/365; 384/462, 571, 590, 606, 607
See application file for complete search history.

(56) References Cited

U.S. PATENT DOCUMENTS

| | | | | | |
|---|---|---|---|---|---|
| RE14,878 | E | * | 6/1920 | Kingsbury | 384/307 |
| 2,032,729 | A | * | 3/1936 | Wallgren | 384/302 |
| 2,054,219 | A | * | 9/1936 | Howarth | 384/306 |
| 2,691,556 | A | * | 10/1954 | Lakey | 384/368 |
| 3,999,897 | A | * | 12/1976 | Strub | 417/365 |
| 4,363,608 | A | * | 12/1982 | Mulders | 417/423.12 |
| 4,871,301 | A | | 10/1989 | Buse | |
| 5,667,314 | A | * | 9/1997 | Limanowka et al. | 384/619 |
| 5,779,434 | A | * | 7/1998 | De Long | 415/104 |
| 5,957,656 | A | | 9/1999 | De Long | |
| 6,264,440 | B1 | | 7/2001 | Klein et al. | |

FOREIGN PATENT DOCUMENTS

| | | |
|---|---|---|
| CA | 2236762 | 11/1998 |

* cited by examiner

*Primary Examiner*—Michael Koczo, Jr.
(74) *Attorney, Agent, or Firm*—Van Someren, PC; Bryan P. Galloway; Jaime A. Castano

(57) ABSTRACT

The present invention provides a thrust bearing assembly and a horizontal skid utilized in a horizontal pumping system. In one embodiment, the thrust bearing assembly comprises a cylindrical open housing, at least one radial ball bearing, at least one rotating seal, and at least one axial thrust bearing. The axial thrust bearing does not have to be completely submerged in lubricant.

18 Claims, 8 Drawing Sheets

HORIZONTAL CENTRIFUGAL PUMPING SYSTEM

This application claims the benefit of U.S. Provisional Application No. 60/382,891, filed May 23, 2002.

FIELD OF THE INVENTION

The subject matter of the present invention relates to horizontal centrifugal pumping systems. More specifically, the subject matter of the present invention relates to a thrust bearing assembly and a pumping skid for use in a horizontal centrifugal pumping system.

BACKGROUND OF THE INVENTION

Horizontal pumping systems are used as surface pumps to boost fluid pressure at specified volumes in applications such as water injection into a disposal well, and lifting of brine from mines to the earth's surface. Such horizontal pumping systems usually comprise a multistage centrifugal pump horizontally mounted to a skid and driven by an electric motor.

SUMMARY OF THE INVENTION

An embodiment of the present invention provides a thrust bearing assembly for use in a horizontal pumping system. In one embodiment, the thrust bearing assembly comprises a cylindrical open housing having a rotating shaft extending therethrough. The cylindrical open housing additionally has end caps each having at least one radial ball bearing and a rotating seal. One of the end caps additionally has at least one axial thrust bearing that is not completely submerged in lubricant.

DETAILED DESCRIPTION OF PREFERRED EMBODIMENTS

Figure 1:
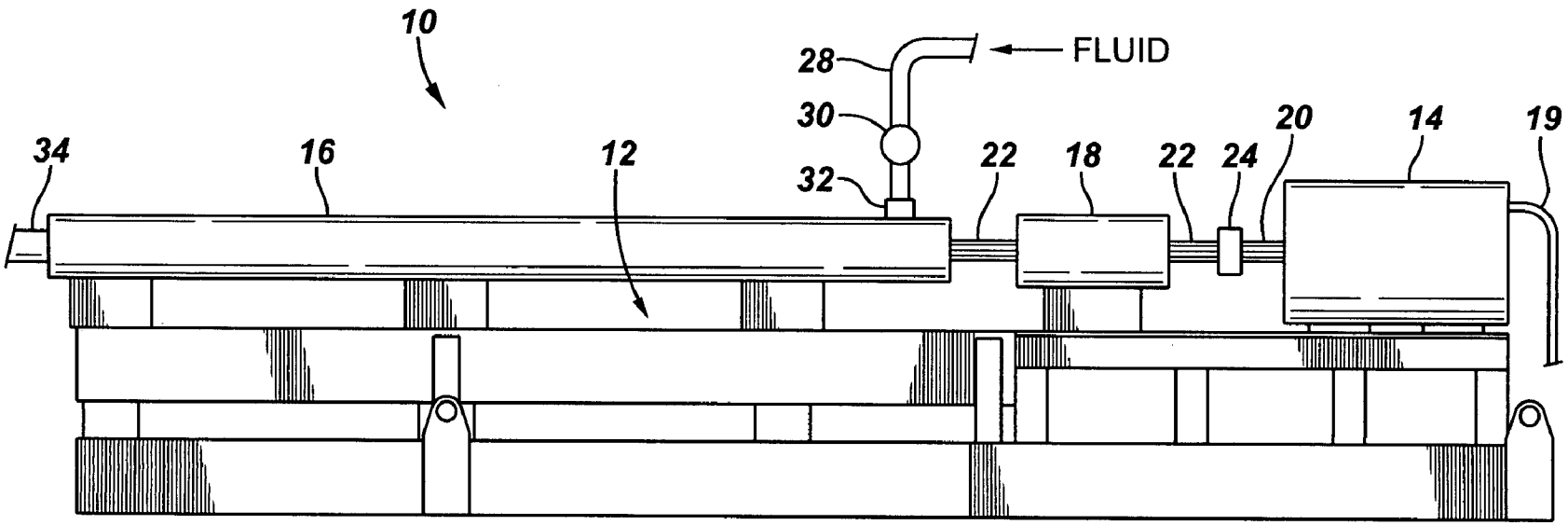
FIG. 1 provides a schematic illustration of an embodiment of a horizontal pumping system having a thrust bearing assembly of the present invention and having a horizontal pumping skid of the present invention.

FIG. 1, shows a schematic side view of a horizontal pumping system 10 having a horizontal thrust bearing assembly 18 of the present invention and a horizontal pumping skid 12 of the present invention. The pumping skid

12 supports an electric motor 14, a centrifugal pump 16, and the thrust bearing assembly 18. The electric motor 14 can be any commercially available AC or DC electric motor. Typical output from the electric motor ranges from 250 HP to 1,000 HP. Electric power is provided to the electric motor 14 through a power cable 19. The operation of the electric motor 14, and thus the horizontal pumping system 10, is controlled by the operation of various switches and gauges located on a control unit (not shown) as is well known in the art.

The electric motor 14 rotates an output shaft 20 that is coupled to a rotor shaft 22. In the embodiment shown, the output shaft 20 is coupled to the rotor shaft 22 by a flanged connection 24. It should be understood that any number of coupling means can be used to advantage and remain within the purview of the present invention.

As shown, the rotor shaft 22 extends through the thrust bearing assembly 18 to the centrifugal, or other, pump 16. The thrust bearing assembly 18 is a skid-mounted assembly designed to absorb the reactive thrust load generated by the horizontally mounted centrifugal pump 16. The reactive thrust load, commonly referred to as down-thrust, is generated from the high pressure liquid being pushed through the pump assembly 16. It should be understood that the centrifugal pumps 16 can be of various pump types, sizes and configurations. Centrifugal pumps 16 can be multistage, progressive cavity, gear pumps, vane pumps, turbines and the like.

Suitable piping and valves is provided in the horizontal pumping system 10 and connected to the centrifugal pump 16. Fluid is provided to the pump 16 through a main conduit 28, through one or more valves 30, and to the intake 32 of the pump 16. Fluid is discharged from the pump 16 through a discharge conduit 34.

Figure 2:
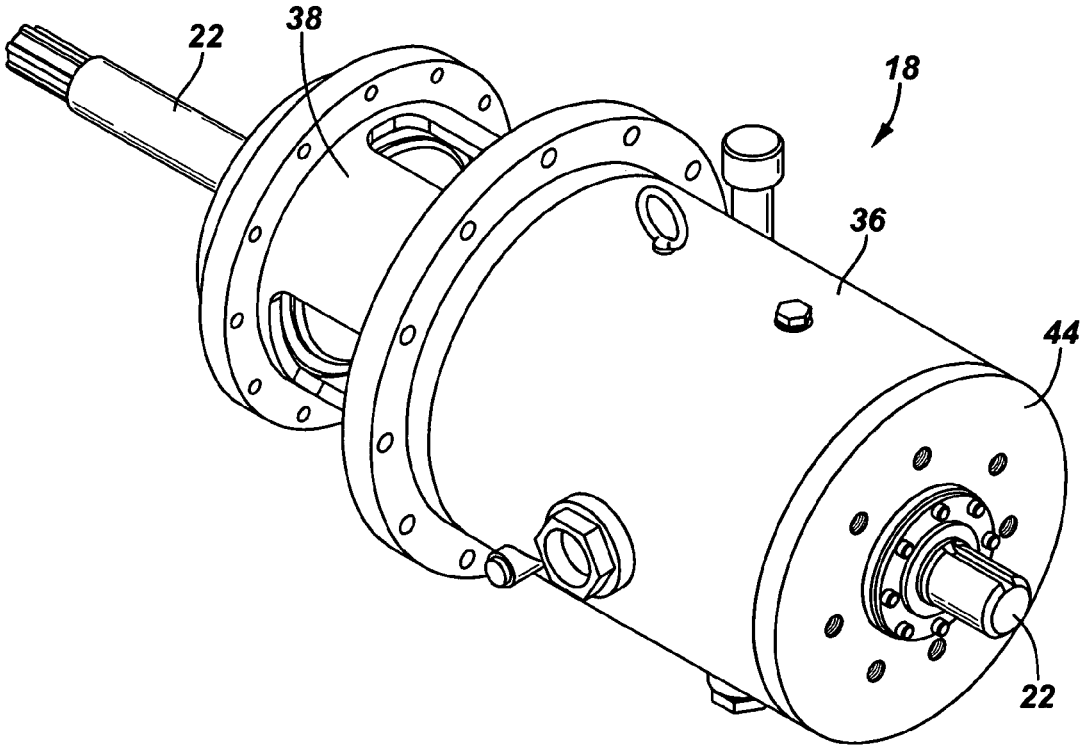
FIG. 2 provides a perspective view of an embodiment of the thrust bearing assembly of the present invention.
Figure 3:
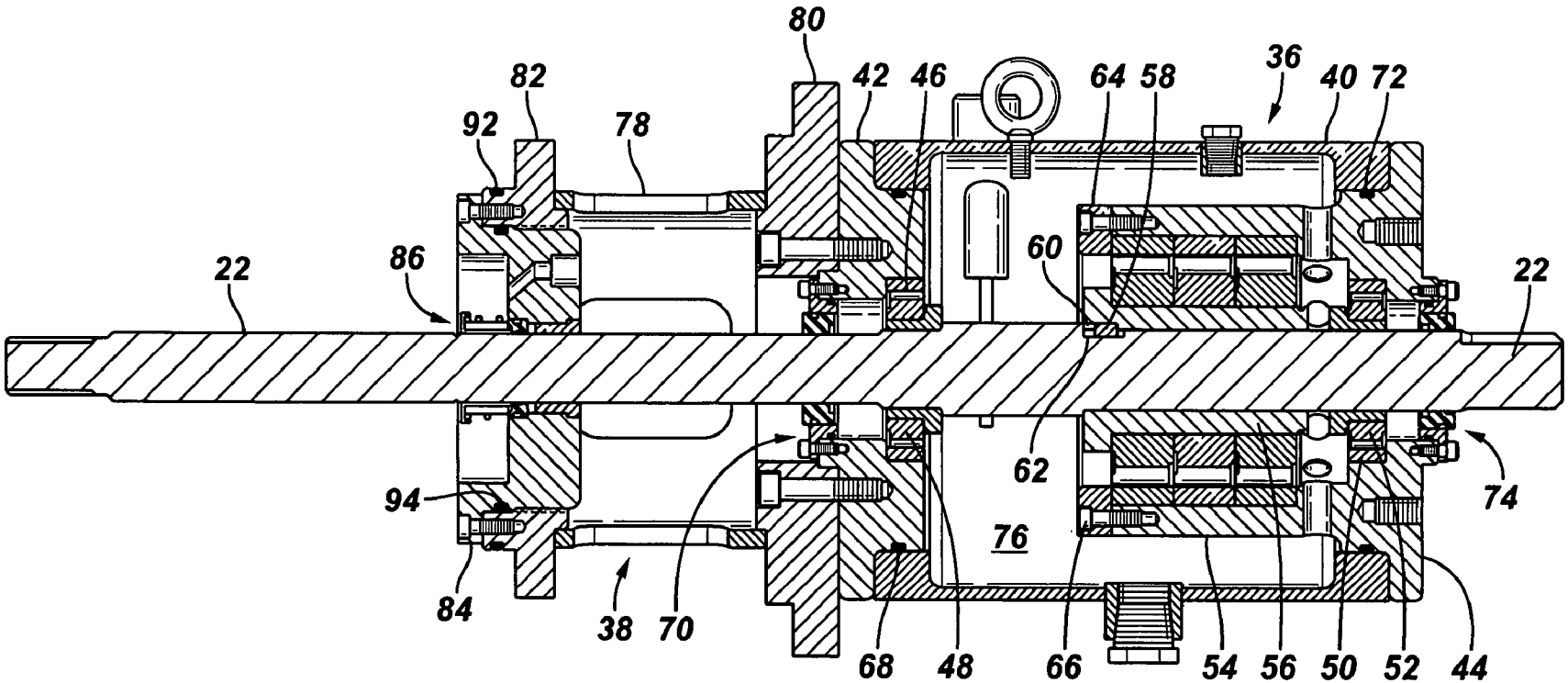
FIG. 3 provides a cross-sectional view of an embodiment of the thrust bearing assembly of the present invention.

The thrust bearing assembly 18 of the present invention is best described with reference to FIGS. 2 and 3 that provide perspective and cross-sectional views, respectively. The thrust bearing assembly 18 is generally comprised of a motor-side housing 36 and an adapter 38. The rotating shaft 22 extends through the center of the thrust bearing assembly 18.

The motor-side housing 36 has a cylindrical housing center section 40 with bolt-on end caps 42, 44 on each end that serve as bearing housings. The bearing housing in the pump-side end cap 42 contains at least one radial ball bearing 46 mounted to a hub 48 utilizing a press fit. Likewise, the bearing housing in the motor-side end cap 44 contains at least one radial ball bearing 50 mounted to a hub 52 utilizing a press fit. The radial ball bearings 46, 50 and hubs 48, 52 are assembled to each end of the rotor shaft 22 utilizing a press fit.

The motor-side end cap 44 additionally contains one or more axial thrust bearings 54. In the embodiment shown, three axial angular contact ball bearings are utilized as the axial thrust bearings 54. It should be understood, however, that other bearing types and other numbers of bearings can be utilized and remain within the scope of the present invention.

The axial thrust bearings 54 are mounted to a hub 56, and the axial thrust bearings 54 and hub 56 are mounted to the rotor shaft 22 by use of a cylindrical pin 58 and a snap ring 60 affixed to a groove 62 in the rotor shaft 22. The cylindrical pin 58 acts as an anti-rotational device with respect to the interface of the axial thrust bearings 54, the hub 56 and the rotor shaft 22. A thrust retainer 64 is provided to prevent axial displacement of the axial thrust bearings 54. The thrust retainer 64 is affixed to the motor-side end cap 44 by fasteners 66, such as threaded fasteners.

The pump-side end cap 42 provides an o-ring 68 and a rotating seal assembly 70 and is affixed to the cylindrical open section 40 of the motor-side housing 36 by fasteners, such as threaded fasteners. Likewise, the motor-side end cap 44 provides an o-ring 72 and a rotating seal assembly 74 and is affixed to the cylindrical open section 40 by fasteners, such as threaded fasteners. The combination of the o-rings 68, 72 and the rotating seal assemblies 70, 74 allows for the capture of fluid in the open chamber 76 of the motor-side housing 36 that is used for the lubrication of the radial ball bearings 46, 50 and the axial thrust bearings 54 contained therein.

In the present design, it is not necessary that the open chamber 76 be flooded with lubricant to acquire proper lubrication of the axial thrust bearings 54. As the thrust bearings 54 rotate with the rotor shaft 22 within the open chamber 76, the bearings 54 are "splashed" with lubricant, such as oil. Thus, lubrication is achieved without the necessity of the bearings 54 being completely submerged in the lubricant. As a consequence, a reduced volume of oil contained within the open chamber 76 can be utilized, which in turn reduces the oil shear and lowers the heat generated within the thrust bearing assembly 18. For example, tests have shown that reducing the oil volume to a level where only 50% of the thrust bearing 54 is in contact with the oil has resulted in reducing the temperature within the open chamber 76 by as much as 80° Fahrenheit.

The adapter 38 of the thrust bearing assembly 18 is generally comprised of a spool-shaped section 78 having two flanged ends 80, 82. The support flange 80 is located proximate the pump-side end cap 42 of the motor-side housing 36 and is affixed to the end cap 42 by fasteners, such as threaded fasteners. The intake flange 82 is located at the pump-side of the adapter 38 and provides a seal assembly housing 84. The seal assembly housing 84 is provided for receipt of a seal assembly 86 that is affixed to the assembly housing 84 by fasteners, such as threaded fasteners. It should be understood that the seal assembly housing 84 can accommodate both cartridge and non-cartridge style rotating pump seal assemblies 86. With a cartridge type seal assembly 86, the seal can be assembled outside of the thrust bearing assembly 18, allowing for rapid change-out and service of the seal assembly 86, if needed.

The intake flange 82 additionally provides o-rings 92, 94. The combination of the o-rings 92, 94 and the seal assembly 86 prevents fluids from entering or exiting the spool assembly 94. from the pump/piping side of the system.

In operation as part of a horizontal pumping system 10, as down-thrust is generated from the connected pump 16 it is transferred to the thrust bearing assembly 18 through the rotor shaft 22. In the present invention, the thrust load is transferred from the rotor shaft 22 to the axial thrust bearings 54. Consequently, the thrust load is transferred to the bearing housing of the motor-side end cap 44.

Figure 4:
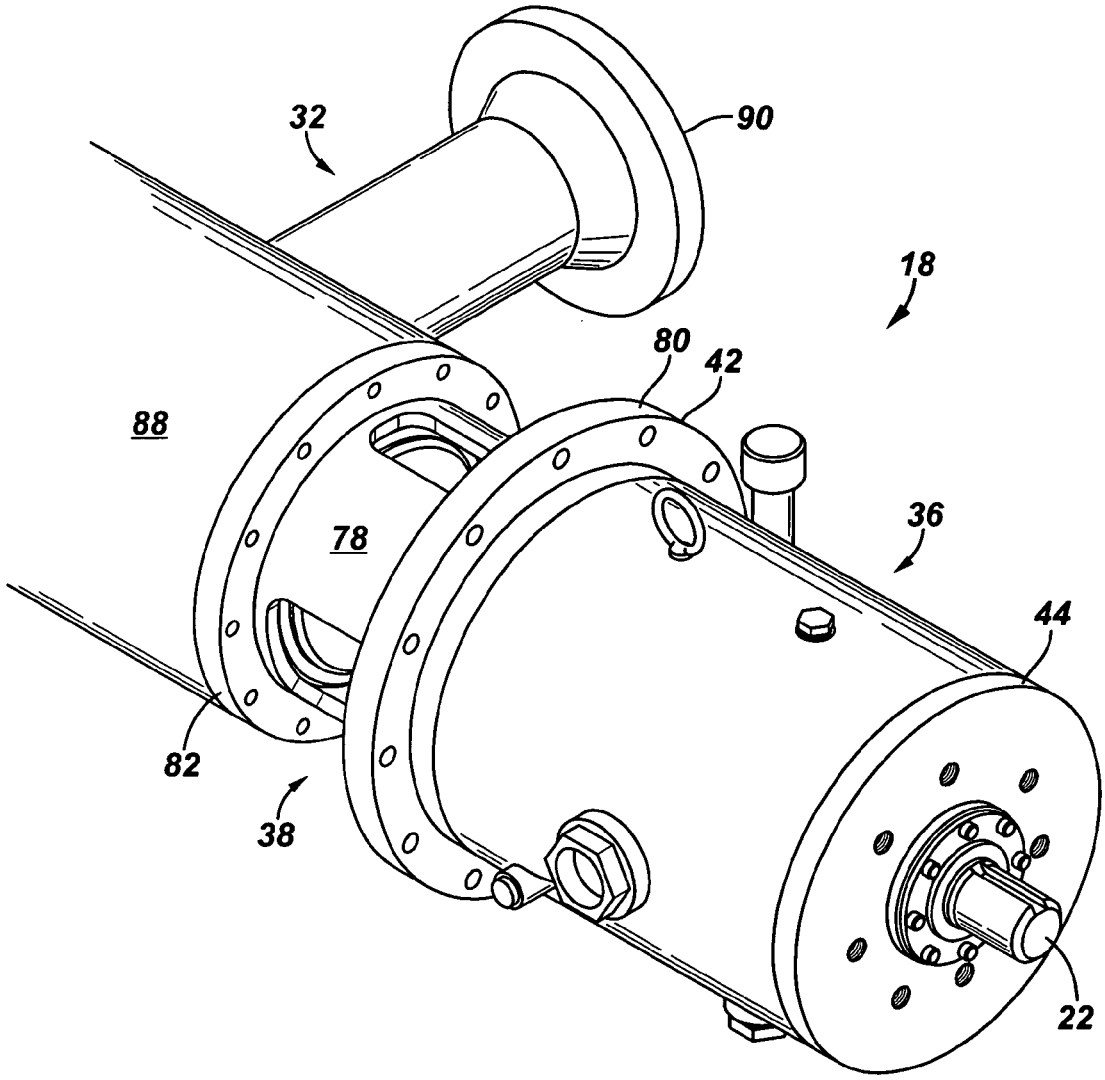
FIG. 4 provides a perspective view of an embodiment of the thrust bearing assembly of the present invention connected to suction piping.

FIG. 4 provides a perspective view of an embodiment of the thrust bearing assembly 18 of the present invention connected to pump suction piping 32. The suction piping 32 generally provides an intake housing 88 that is connected to, or integral with, a pump (not shown). The suction piping 32 additionally provides a suction chamber 90 for receipt of intake fluids. The intake fluids received in the suction chamber 90 are able to travel through the intake housing 88 and into the pump. The thrust bearing assembly 18 is connected to the suction piping 32 at the intake flange 82 of the spool assembly 38 by fasteners, such as threaded fasteners.

Figure 5:
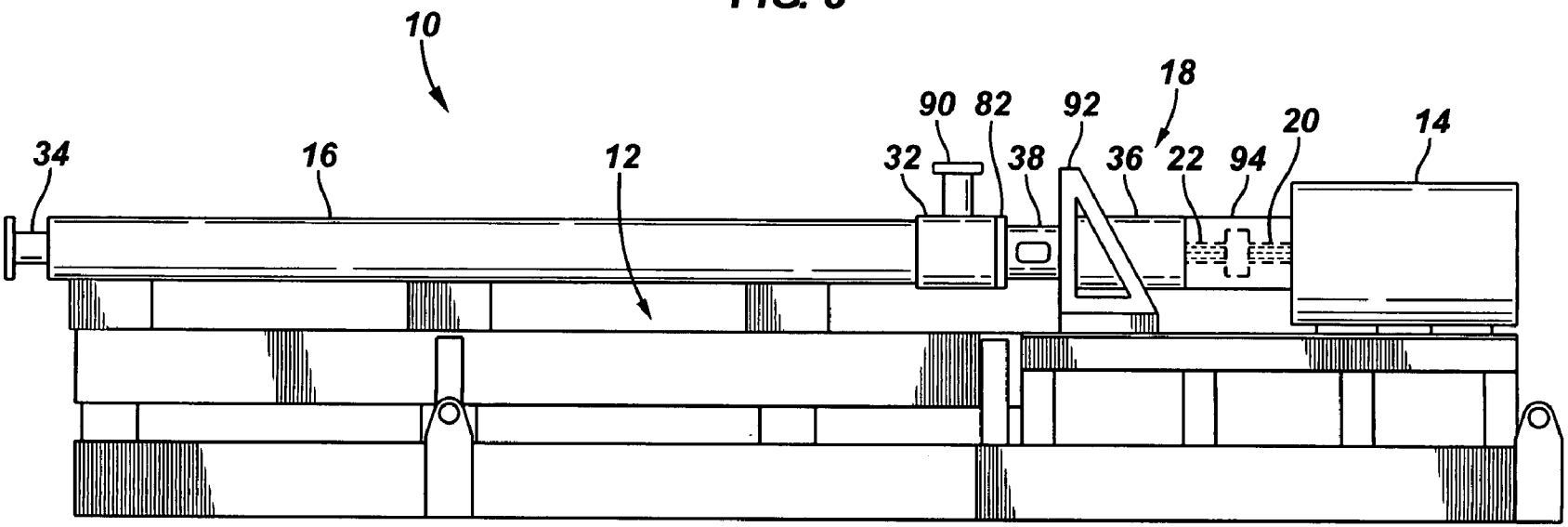
FIG. 5 provides a side view of an embodiment of the thrust bearing assembly of the present invention supported by a pumping skid of the present invention.
Figure 6:
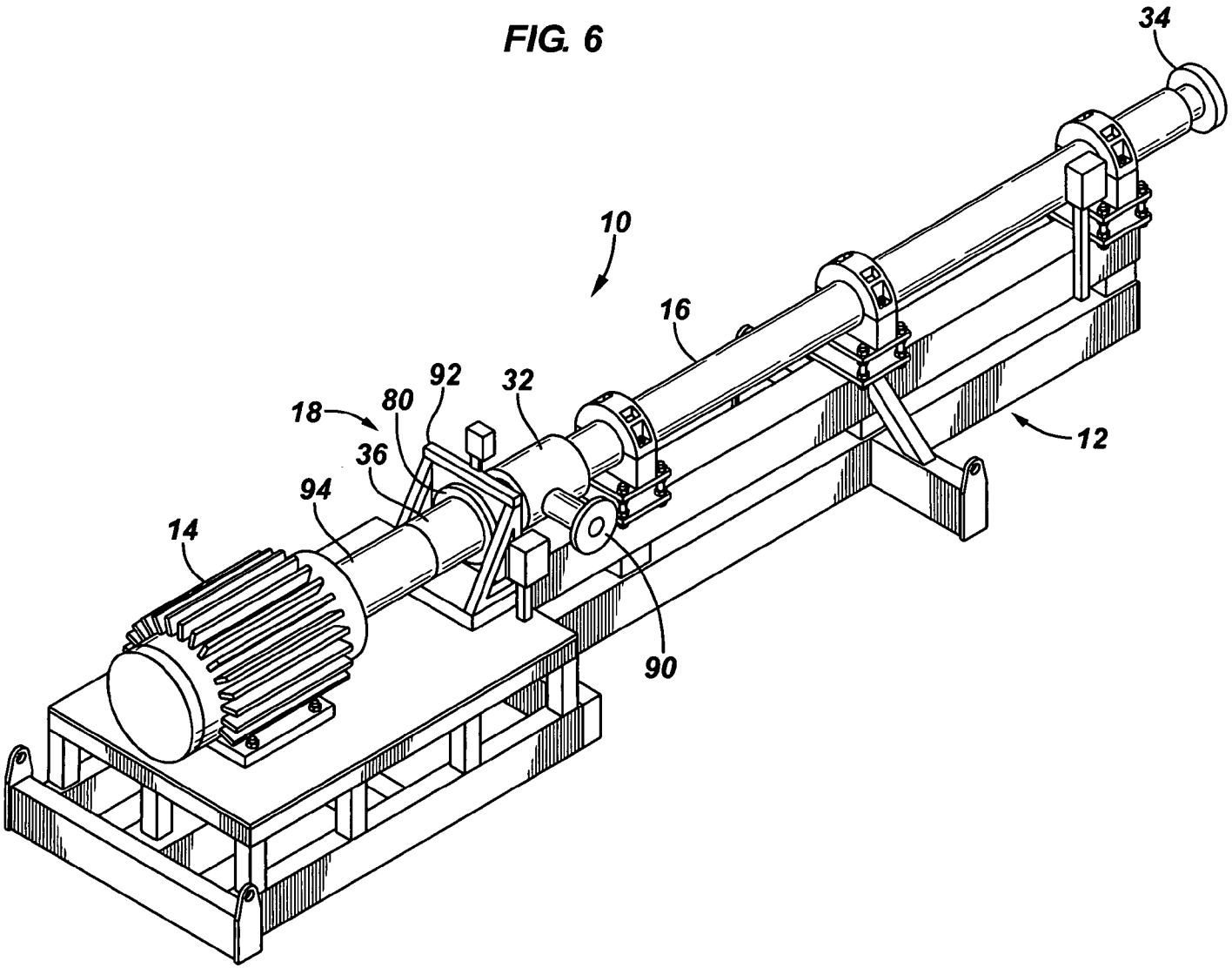
FIG. 6 provides a perspective view of an embodiment of the thrust bearing assembly of the present invention supported by a pumping skid of the present invention.

FIGS. 5 and 6 provide side and perspective views, respectively, of an embodiment of the thrust bearing assembly 18 of the present invention included within a horizontal pumping system 10. For illustration purposes, the horizontal pumping system 10 is supported by an embodiment of a horizontal pumping skid 12 (described below) of the present invention, but could also be supported by a conventional or alternatively designed skid and remain within the purview of the invention.

The thrust bearing assembly 18 is connected within the system 10 intermediate the motor 14 and the pump 16. On the pump-side of the thrust bearing assembly 18, the intake flange 82 of the adapter 38 is connected to the suction piping 32. The suction piping provides a suction chamber 90 and is affixed to the suction side of the pump 16. The support flange 80 of the adapter 38 is connected to the motor-side of a support bracket 92. The support bracket 92 is rigidly affixed to the pumping skid 12 to provide support for the thrust bearing assembly 18.

On the motor-side of the thrust bearing assembly 18, a coupling guard 94 is provided intermediate the motor-side housing 36 and the motor 14. In one embodiment, the coupling guard 94 is a removable sleeve that acts as a protective sleeve for the output shaft 20 and the rotor shaft 22. The coupling guard 94 can be secured in place by fasteners, such as threaded fasteners for example.

The thrust bearing assembly 18 of the present invention is a "back pull-out" design. As such, in the event that the thrust bearing assembly 18 requires seal or bearing replacement and/or service, the same can be accomplished without disturbing the piping connections. In other words, the thrust bearing assembly 18 can be serviced without having to break the connections at the suction piping 32 or at the discharge piping 34.

To service the "back pull-out" thrust bearing assembly 18, the valves (not shown) controlling flow to the suction piping 32 are first closed to drain the pumping system 10. Once flow into the system 10 is stopped, the intake flange 82 of the adapter 38 is disconnected from the suction piping 32. The support flange 80 of the adapter 38 is then disconnected from the motor-side of the support bracket 92. Next the coupling guard 94 is removed and the output shaft 20 and the rotor shaft 22 are disconnected. At this point, the thrust bearing assembly 18 can be removed from the system by tilting at an angle sufficient to provide clearance for the rotor shaft 22.

To accomplish the above "back pull-out" for varying lengths of rotor shafts 22 that extend from the spool assembly 38, the spacing between the motor 14 and the thrust bearing assembly 18 can be varied. Accordingly, the length of the coupling guard 94 is adjusted.

Figure 7:
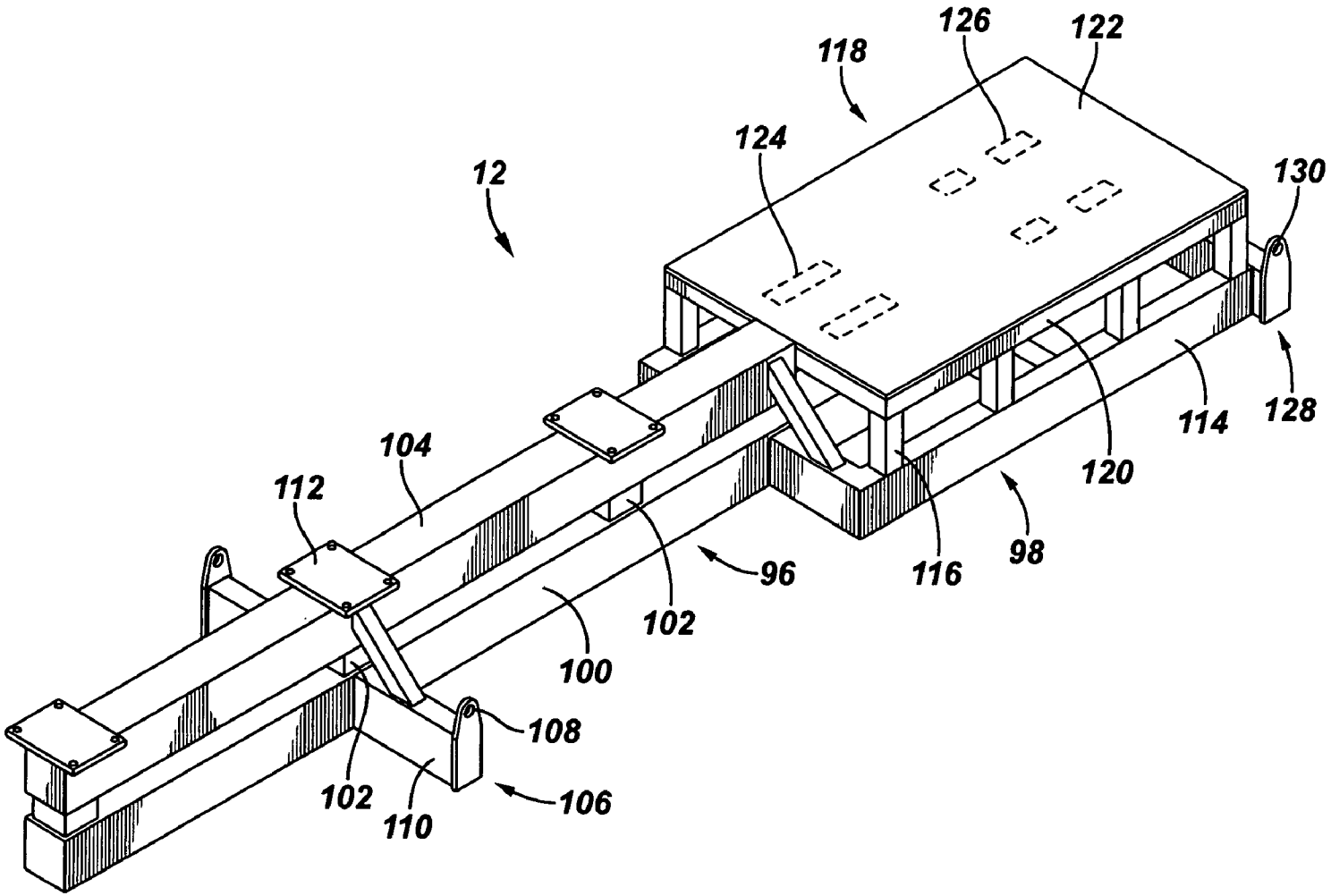
FIG. 7 provides a perspective view of an embodiment of the horizontal pumping skid of the present invention.
Figure 8:
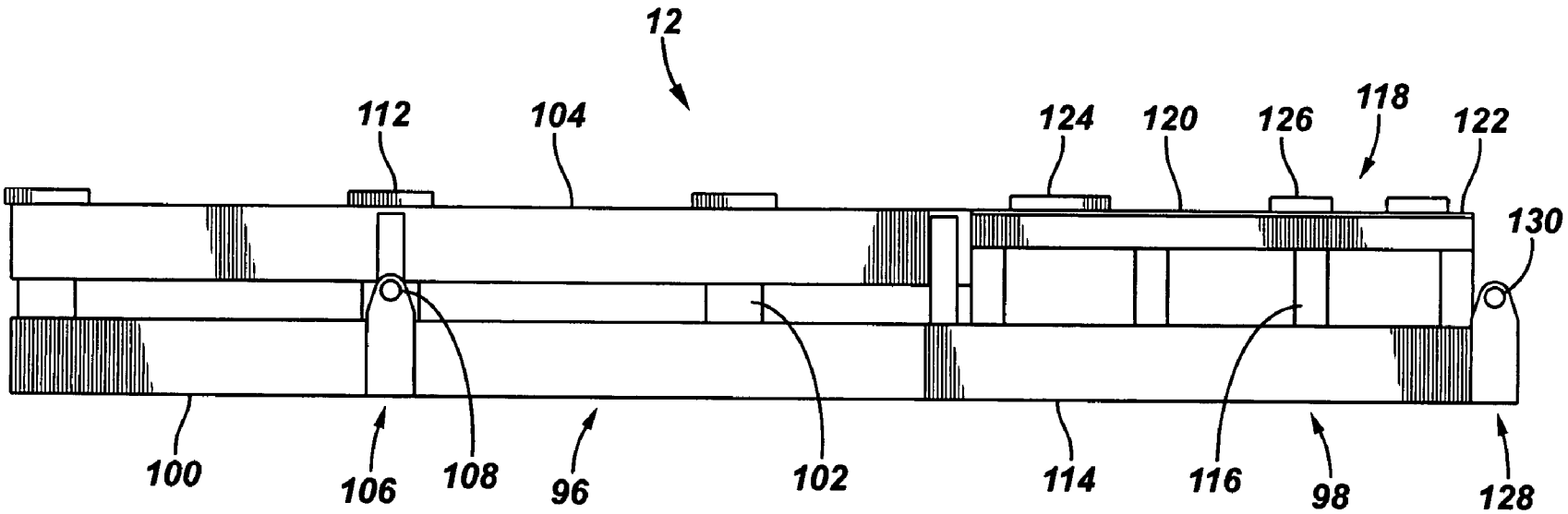
FIG. 8 provides a side view of an embodiment of the horizontal pumping skid of the present invention.

With reference to FIGS. 7 and 8, an embodiment of the horizontal pumping skid 12 of the present invention is described. FIG. 7 provides a perspective view and FIG. 8 provides a side view.

The horizontal pumping skid 12 provides a pump base assembly 96 and a motor base assembly 98. The pump base assembly 96 has a main lower rectangular tube 100 that extends the length of the skid 12. Welded to the upper surface of the lower rectangular tube 100 are one or more rectangular support braces 102 that provide support for the upper rectangular tube 104 that is welded thereto. The upper rectangular tube 104 and the lower rectangular tube 100 are aligned along the centerline of the pump.

The pump base assembly 96 additionally has one or more stabilizers 106 that are welded thereto. The stabilizers 106 comprise a lifting eye 108 utilized for lifting and maneuvering the skid 12. The stabilizers 106 additionally comprise a bracing tube 110 that is utilized to stabilize the pumping skid 12 during operation. One or more support plates 112 are welded to the upper surface of the upper rectangular tube 104 to provide support for a horizontal pump.

The motor base assembly 98 has a lower motor base structure 114 that is welded to the lower rectangular tube 100. Welded to the upper surface of the lower motor base structure 114 are a series of vertical support arms 116 that provide support for the motor base 118 that is welded thereto.

The motor base 118 comprises a horizontal welded square tube frame 120 that provides support for a motor base plate 122. Welded to the upper surface of the motor base plate 122 are one or more thrust bearing pads 124 and one or more motor pads 126. The thrust bearing pads 124 provide support for a bracket 92 (shown in FIG. 6) that stabilizes the thrust bearing assembly 18. In an embodiment of the present invention, the motor pads 126 are milled after welding to eliminate potential "soft foot" problems.

The motor base assembly 98 additionally has one or more stabilizers 128 that are welded thereto. The stabilizers 128 comprise a lifting eye 130 utilized for lifting and maneuvering the skid. The stabilizers 128 are additionally utilized to stabilize the pumping skid 12 during operation.

Referring back to FIG. 6, an embodiment of the horizontal pumping skid 12 of the present invention is shown providing support for a horizontal pumping system 10 utilizing a thrust bearing assembly 18 of the present invention. Providing a rectangular tube pump base assembly 96 that is aligned along the centerline of the pump 16 provides increased rigidity coupled with ease of manufacturing. The pumping skid 12 is less susceptible to flexing during pump operation. Further, the centerline aligned pump base assembly 96 minimizes the potential trip hazard when working around the pumping system 10.

The invention being thus described, it will be obvious that the same may be varied in many ways. For example, it should be understood that the thrust bearing assembly 18 of the present invention can be used within a horizontal pumping system 10 utilizing a conventional or alternatively designed skid. Likewise, the pumping skid 12 of the present invention can be used to support a horizontal pumping system 10 having a conventional or an alternatively designed thrust bearing assembly 18. Such variations are not to be regarded as a departure from the spirit and scope of the invention, and all such are intended to be included within the scope of the following non-limiting claims.

What is claimed is:

1. A thrust bearing assembly for use in a horizontal pumping system, comprising:

a housing;

a rotating shaft extending through the housing;

one or more housing seals disposed in the housing about the rotating shaft;

at least one axial thrust bearing affixed to the rotating shaft within the housing; and a volume of lubricant retained in the housing by the one or more seals; wherein the volume of lubricant is maintained at a level that does not completely submerge the at least one axial thrust bearing such that the at least one axial thrust bearing is lubricated by being splashed with lubricant as the at least one axial thrust bearing rotates through the volume of lubricant.

2. The thrust bearing assembly of claim 1, wherein the housing comprises a pump-side and a motor-side and the one or more housing seals are contained within a pump-side housing end cap and a motor-side housing end cap.

3. The thrust bearing assembly of claim 2, wherein the pump-side housing end cap and the motor-side housing end cap further comprise at least one bearing affixed to the shaft.

4. The thrust bearing assembly of claim 1, wherein the at least one axial thrust bearing comprises a ball bearing.

5. The thrust bearing assembly of claim 1, wherein the lubricant is oil.

6. The thrust bearing assembly of claim 1, wherein the volume of lubricant submerges less than fifty percent (50%) of the at least one axial thrust bearing.

7. A thrust bearing assembly for use in a horizontal pumping system, comprising:

a housing;

a rotating shaft extending through the housing;

one or more housing seals disposed in the housing about the rotating shaft;

at least one axial thrust bearing affixed to the rotating shaft within the housing;

a volume of lubricant retained in the housing by the one or more seals; wherein the volume of lubricant is maintained at a level that does not completely submerge the at least one axial thrust bearing; and an adapter having its proximate end affixed to the housing and having a distal end adapted for connection to pump suction piping, the adapter having a rotating pump seal assembly contained therein.

8. The thrust bearing assembly of claim 7, wherein the rotating pump seal assembly is adapted to receive cartridge type seal assemblies.

9. The thrust bearing assembly of claim 7, wherein the rotating pump seal assembly is provided to prevent the passage of fluid through the distal end of the adapter.

10. A horizontal pumping system, comprising:

a motor;

a shaft driven by the motor;

a pump driven by the shaft; and a thrust bearing assembly positioned intermediate the motor and pump, the thrust bearing assembly having the shaft running through a chamber, the chamber having seals disposed about the shaft to maintain a volume of lubricant therein, the thrust bearing assembly having at least one axial thrust bearing that is not completely submerged in the volume of lubricant such that the at least one axial thrust bearing is lubricated by being splashed with lubricant as the at least one axial thrust bearing rotates through the volume of lubricant.

11. The horizontal pumping system of claim 10, wherein the seals are disposed about the shaft to enable rotation of the shaft while maintaining the volume of lubricant.

12. The horizontal pumping system of claim 10, wherein the seals are housed within chamber end caps.

13. The horizontal pumping system of claim 10, wherein the at least one axial thrust bearing comprises a ball bearing.

14. The horizontal pumping system of claim 10, wherein the lubricant is oil.

15. The horizontal pumping system of claim 10, wherein the volume of lubricant submerges less than fifty percent (50%) of the at least one axial thrust bearing.

16. The thrust bearing assembly of claim 10, further comprising:

an adapter intermediate the open chamber and the pump, the adapter having a rotating pump seal assembly contained therein.

17. The thrust bearing assembly of claim 16, wherein the rotating pump seal assembly is adapted to receive cartridge type seal assemblies.

18. The thrust bearing assembly of claim 16, wherein the rotating pump seal assembly is provided to prevent the passage of fluid through the adapter.

* * * * *